US007384317B1

(12) United States Patent
Pijoan Parellada et al.

(10) Patent No.: US 7,384,317 B1
(45) Date of Patent: Jun. 10, 2008

(54) MULTI-TERMINAL BLOCK FOR ELECTRONIC DEVICES HAVING SUPERIMPOSED CONDUCTOR CONNECTING LEVELS

(75) Inventors: Josep Pijoan Parellada, Mostoles (ES); Eduardo Calleja Hernandez, Madrid (ES)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/643,466

(22) Filed: Dec. 21, 2006

(51) Int. Cl.
*H01R 4/36* (2006.01)

(52) U.S. Cl. ..... 439/814

(58) Field of Classification Search ..... 439/709, 439/637, 94, 716, 814, 329, 723, 787, 545
See application file for complete search history.

(56) References Cited

U.S. PATENT DOCUMENTS 4,171,861 A * 10/1979 Hohorst ..... 439/94
4,276,526 A 6/1981 Ciarcia et al. ..... 335/35
4,343,529 A * 8/1982 Reavis et al. ..... 439/406
5,221,218 A * 6/1993 Marach ..... 439/637
5,994,989 A * 11/1999 Rowe et al. ..... 335/202
6,102,750 A * 8/2000 Little et al. ..... 439/813
6,146,187 A * 11/2000 Pallai ..... 439/441
6,231,405 B1 * 5/2001 Diconne et al. ..... 439/812
6,250,950 B1 * 6/2001 Pallai ..... 439/441
6,328,580 B2 * 12/2001 Hanning et al. ..... 439/98
6,632,108 B1 * 10/2003 Hohlfelder ..... 439/709
7,094,071 B2 * 8/2006 Hackemack et al. ..... 439/76.1
7,285,019 B2 * 10/2007 Sakai et al. ..... 439/620.09
2007/0049104 A1 * 3/2007 Reibke ..... 439/404

FOREIGN PATENT DOCUMENTS

WO WO 03/028162 4/2003

* cited by examiner

*Primary Examiner*—Chandrika Prasad
(74) *Attorney, Agent, or Firm*—Ohlandt, Greeley, Ruggiero & Perle, L.L.P.

(57) ABSTRACT

A multi-terminal block for electric devices, comprising two superimposed connecting levels for conductors, which can be used independent of each other, the multi-terminal block comprising: a first terminal block comprising a cage screw type conductor connector which comprises a cage and a screw for use securing the a first conductor, wherein the first terminal block cooperates with a terminal; and a second terminal block comprising a quick connecting type conductor connector, wherein the quick connecting type conductor connector comprises a strip spring for securing a second conductor, wherein the screw does not extend through the second terminal block and wherein the second terminal block is partially disposed within the cage such that the second terminal block cooperates with the terminal.

8 Claims, 6 Drawing Sheets

MULTI-TERMINAL BLOCK FOR ELECTRONIC DEVICES HAVING SUPERIMPOSED CONDUCTOR CONNECTING LEVELS

BACKGROUND

1. Field

The present disclosure relates generally to a multi-terminal block for electric devices, having two superimposed connecting levels for conductors, which can be used independent of each other. In particular, the double terminal connection of the present disclosure is used in MiniCircuit Breakers (MCB) and Residual Current Circuit Breakers (RCCB), wherein the terminal has two independent connections, i.e., a cage screw type and a second pin plug-in. The second terminal is preferably designed to connect a pin busbar without a screw, instead utilizes a metal sheet spring, with a shape that resembles the number "5". The plug-in is surrounded by the terminal cage belonging to the screw type connection. In order to access to the bladespring the pin busbar goes through the window of the terminal.

2. Discussion of the Background Art

Conventional double connection terminals for use in electrical circuit breakers typically require two terminal cage screw busbars. Conventional terminals in the electric circuit breakers typically require a terminal cage screw busbars without the possibility to have a quick insertion connection, neither have both types; cage terminal for cables or screwed busbar and quick connection.

One solution to the problem of a two terminal cage screw busbars is disclosed in International Patent Publication No. WO03/028162 (Assigned to Hager Electro S. A.), which uses a fork busbar. According to the Hager patent publication a double connection terminal strip for a modular electrical apparatus is provided with two superimposed levels for connecting conductors capable of being used independently of each other, a first terminal strip of the cage type co-operating with a terminal and a member for clamping/releasing the conductor, accessible from the front surface of the housing of the apparatus including a control lever, the second terminal strip being of the fast-connect type with elastic elements and a without clamping member, the second terminal strip being arranged between the front surface for access to the clamping/releasing member and the cage for connecting the first terminal strip, and being self-supporting by the latter so as not to transmit stresses to the housing.

The present disclosure also provides many additional advantages, which shall become apparent as described below.

SUMMARY

A multi-terminal block for electric devices, comprising two superimposed connecting levels for conductors, which can be used independent of each other, the multi-terminal block comprising: a first terminal block comprising a cage screw type conductor connector which comprises a cage and a screw for use securing the a first conductor, wherein the first terminal block cooperates with a terminal; and a second terminal block comprising a quick connecting type conductor connector, wherein the quick connecting type conductor connector comprises a strip spring for securing a second conductor, wherein the screw does not extend through the second terminal block and wherein the second terminal block is partially disposed within the cage such that the second terminal block cooperates with the terminal.

Preferably, the terminal comprises an insertion window that communicates with the second terminal block. A pin type busbar is disposed within the insertion window and the second terminal block.

The strip spring is formed of a sheet metal spring and has a shape that resembles the number "5". The strip spring comprises a free end which is elastically supported on a surface of the terminal substantially parallel to the axis of the insertion window. Additionally, the strip spring comprises a plurality of wings which holds the strip spring parallel to the axis of the insertion window. The strip spring also preferably has a plurality of legs that hold the strip spring inside the second terminal block.

Further objects, features and advantages of the present disclosure will be understood by reference to the following drawings and detailed description.

DETAILED DESCRIPTION OF THE PREFERRED EMBODIMENT

Figure 1:
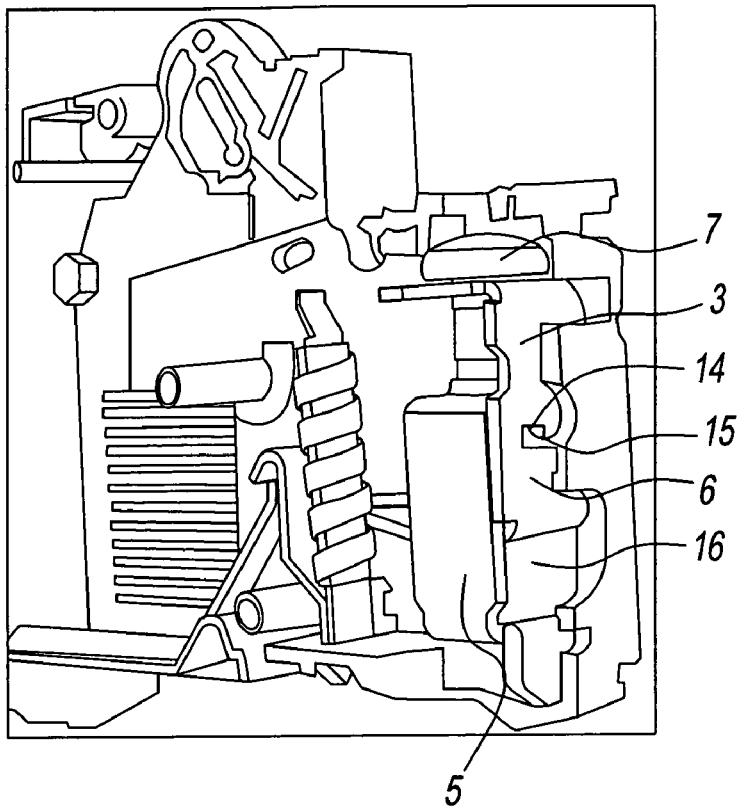
FIG. 1 is a perspective view of a modular electric device as per the present disclosure, having two superimposed connection zones.
Figure 2:
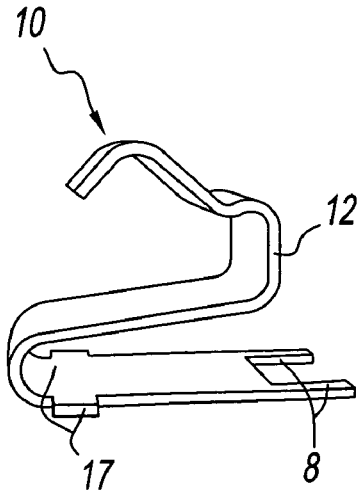
FIG. 2 is a perspective view, of the strip spring according to the present disclosure having a shape that resembles a the numeral "5"
Figure 3:
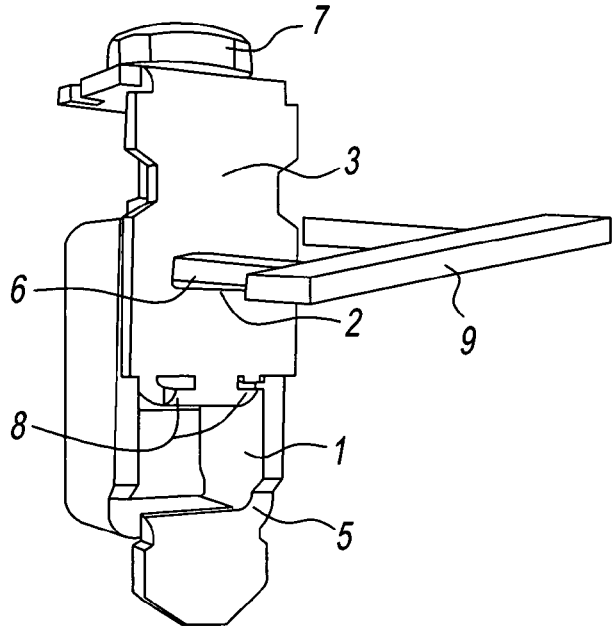
FIG. 3 is an enlarged perspective view of the different elements of the configuration of the multi-terminal block as per a first embodiment of the present disclosure with pin type busbar.
Figure 4A:
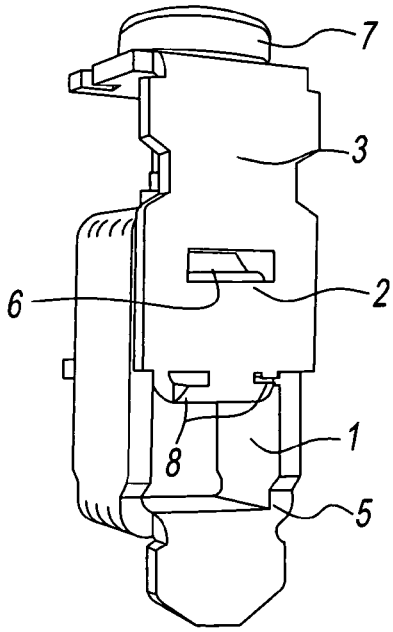
FIGS. 4*a* and *b* is a perspective view of the embodiment of FIGS. 1-3 in the assembled condition.
Figure 4B:
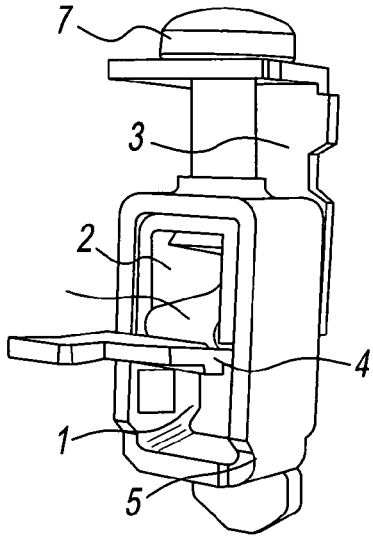

The present disclosure can best be understood by reference to the attached drawings, wherein FIGS. 1-4 depict a double connection terminal block, with two independent connection types for cable connection 16. The first terminal connection block 1 is a cage type that cooperates with terminal 3, second terminal block 2 being of rapid connection type with spring element 10. Second terminal 2 is surrounded partially by cage 5 of first terminal 3 and its accessible through window 6 in front side of the terminal. Second terminal 2 is characterized in that the spring allocation cavity 4 is below screw 7.

Preferably, second terminal block 2 has a strip spring type 10 whose free end 12 is elastically supported on one surface of terminal 3 parallel to the insertion window (6) axis. Preferably, strip spring 10 has two wings 17 that hold the spring parallel to insertion window 6 axis. Moreover, strip spring 10 has two legs 8 that hold strip spring 10 inside terminal cavity avoiding that the strip spring displaces in the insertion direction. In the preferred embodiment, strip spring 10 has a shape that resembles the number "5". This configuration allows for the first bend that meets a pin busbar indicates to the installer that the pin busbar is in the right place by giving some resistance to the pin insertion (at this stage the installer can see some pin busbar surface outside the apparatus). Then, the installer should press the pin more forcefully in order to insert it properly (at this stage the installer cannot see any pin busbar surface outside the apparatus). It is the second bend that will press the pin busbar against the terminal, and it makes the contact force in order to have a proper electrical connection.

Figure 12:
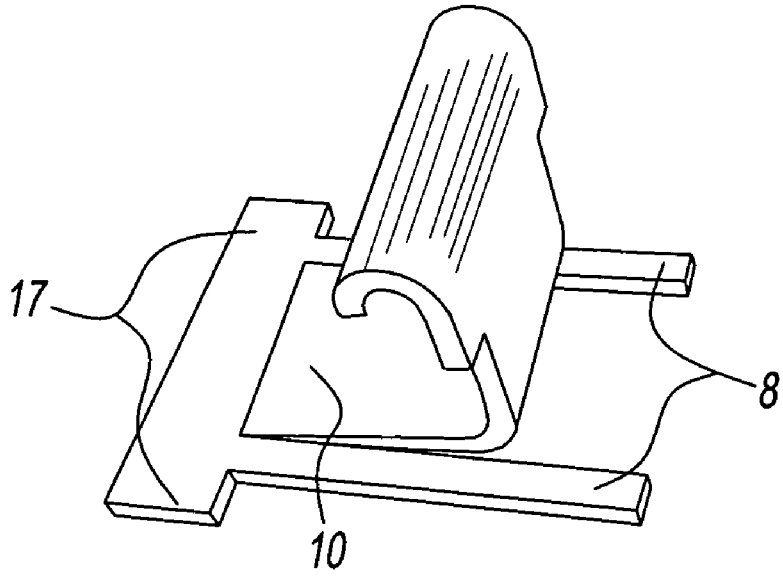
FIG. 12 is a perspective view, of the strip spring according to the present disclosure having a flexible "L" shape.
Figure 13:
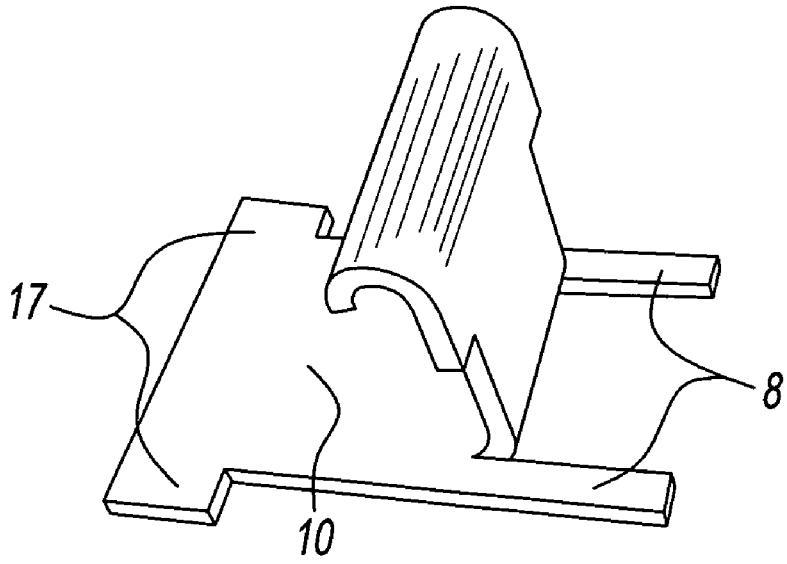
FIG. 13 is a perspective view of the strip spring according to the present disclosure having a less flexible "L" shape.
Figure 14A:
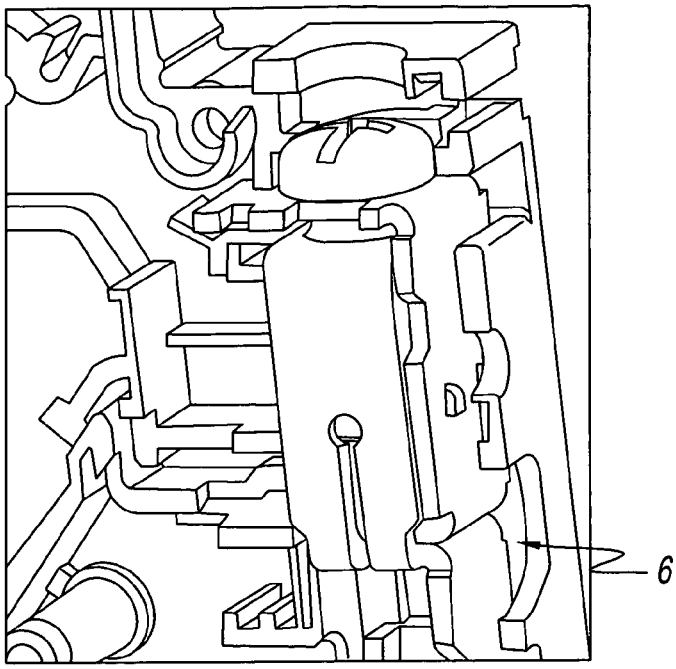
FIGS. 14*a-d* is a perspective view of the multi-terminal according to still another embodiment of the present disclosure.
Figure 14B:
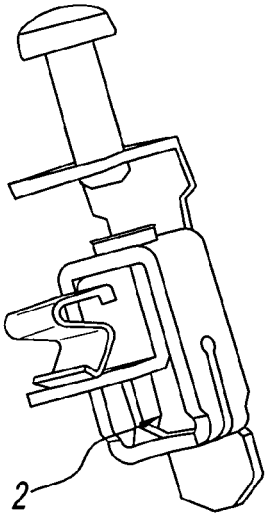
Figure 14D:
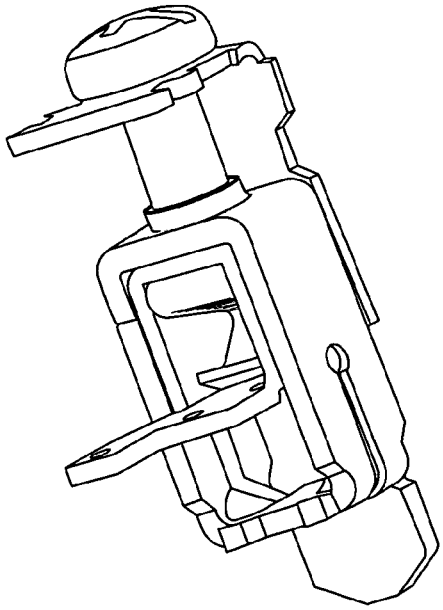
Figure 14C:
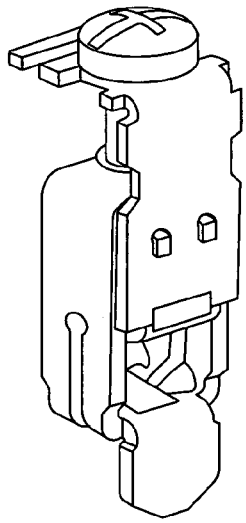

FIGS. 12 and 13 depict optional strip spring configurations, i.e. a flexible "L" shaped strip spring and a less flexible "L" shaped strip spring, respectively.

Second connection terminal block 2 is for pin busbar 9 is enters via busbar inserts 14,15.

First terminal block 1 is the cage type cooperating with one fixed terminal and screw 7 for tightening and loosening the conductor, which is accessible from the front surface of the device facing the user in the installed condition, i.e. that which has a operating handle/toggle. Second terminal block 2 is of the quick connecting type based on an elastic element and without tightening part.

Double connections on the same lateral side of an electric device require adaptation to the terminals or a particular order in the relative arrangement of these terminals so that their respective spaces are separated. Traditional cage and screw type terminals have mechanical parts which extend up to the front surface of the box, the quick connection type of terminals are arranged inside the cage and below the tip of the screw but away from the space for cable insertion.

It is preferable, to have a quick connection type terminal arranged towards a front surface and a screw clamp arrangement towards a fixing side of electric device as a bridging comb and access to it is as easy as possible and consequently is not burdened by other connections present in the foreground and using the terminals closest to the surface of the product.

According to the present disclosure, second terminal 2 is arranged between the front surface, below the tip of screw 7 of the first standard terminal and inside its connection cage, and is self-supported by fixed terminal so as not to transmit any load to the electric device.

A modular device provided with two levels on superimposed levels are provided so that the quick connection level is reserved for the supply and for the electrical distribution of the product, by direct plugging/pining of the conductors which preferably are of the bridging rod type. The traditional level includes the cage united with a fixed terminal is preferably reserved for the supply of current, by cable or also by bridging rod.

Figure 5:
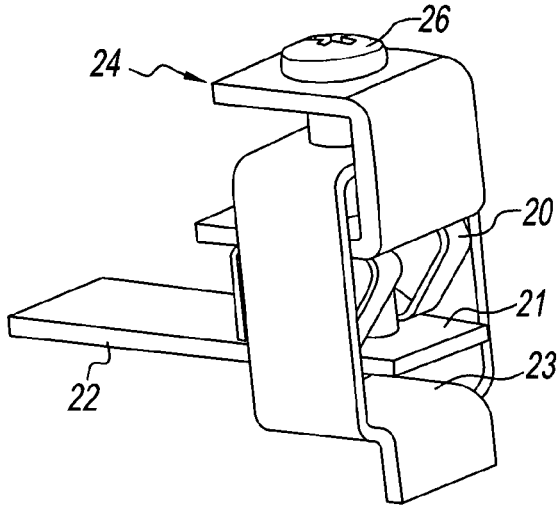
FIG. 5 is a perspective view of a strip spring used according to a second embodiment of the present invention.

The second terminal can be of the strip spring type, whose free end is elastically supported on a surface of the fixed terminal parallel to the axis of insertion of the conductors, According to one possibility, the strip spring is fixed to a lower leg of the fixed terminal, whereas its free end is supported by added flat portion of fixed terminal which is parallel to the axis of insertion of a conductor, and forms with extension of one of two side edges of the fixed terminal and bent twice inwardly to form close loop with another side edge extended normal the lower leg of fixed terminal. The flat portion is, in addition, provided stopper for the screw component, so as to organize the relative motion between the fixed terminal and cage of the first terminal According to an alternate embodiment shown in FIGS. 5-7, the strip spring 20 is directly fixed to terminal connector 22, on a portion of the shape parallel to the axis of insertion of the conductors, however, fixed terminal 24 and terminal connector 22 are two different parts, rigidly held by a housing, fixed terminal 24 can be made of stronger and cost effective material than terminal connector 22 which is of course conductive.

In this case, the shape of strip spring 20 is of course different from that which used in the embodiment shown in FIGS. 1-4. Strip spring 20 is held by terminal connector 22. Lines 21 and 23 show the busbar insertion point and cable connection slot, respectively.

Figure 6:
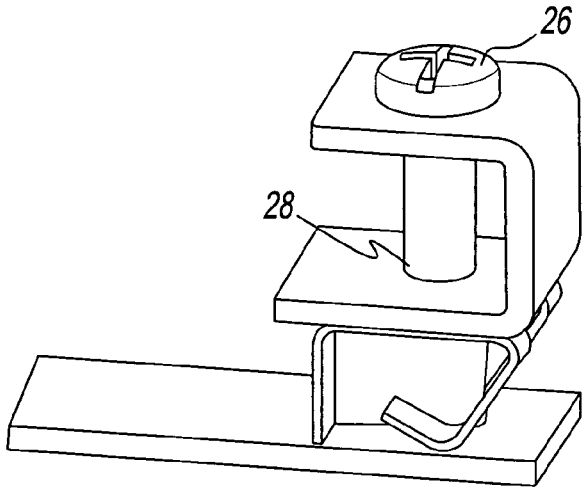
FIG. 6 is a perspective view of different elements of the multi-terminal assembly of FIG. 5.
Figure 7:
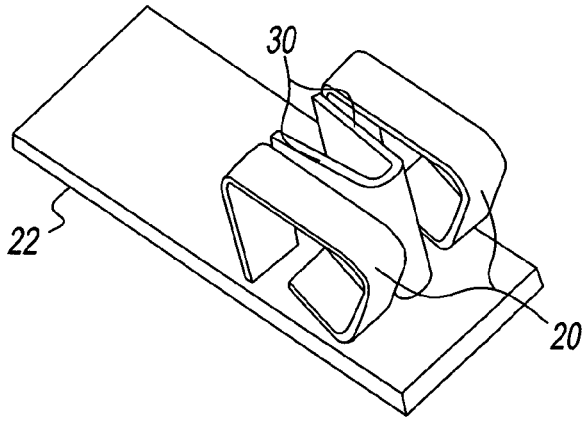
FIG. 7 is an enlarged perspective view of the strip spring according to the embodiment of FIGS. 5 and 6, above.
Figure 8:
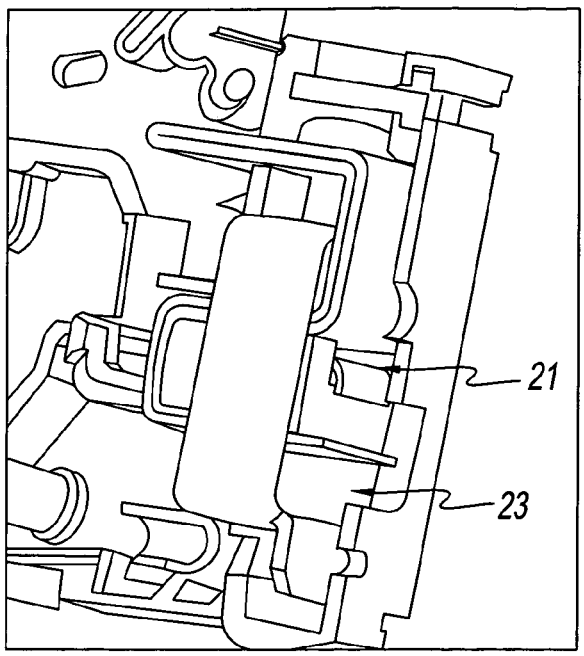
FIG. 8 is a perspective view of a multi-terminal according to a third embodiment of the present disclosure, wherein the multi-terminal has been implanted in a modular electric device.
Figure 9:
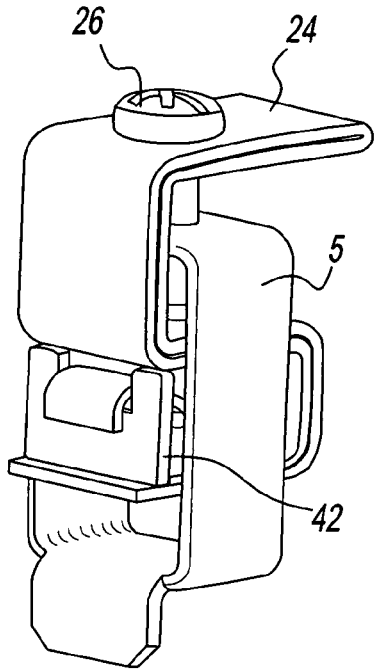
FIG. 9 shows an enlarged perspective view of the different elements of the multi-terminal block of FIG. 8.
Figure 10:
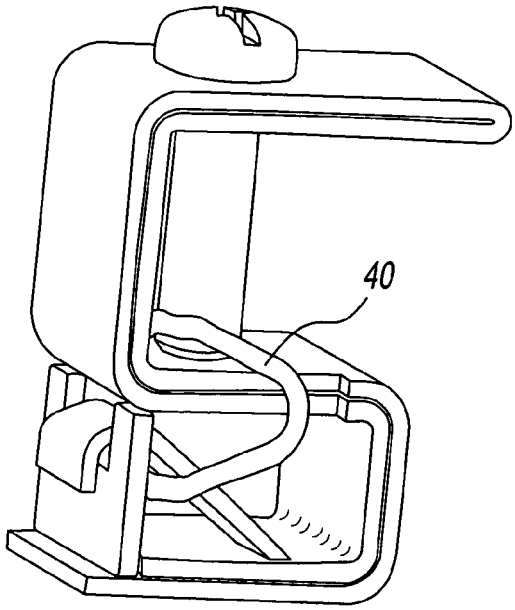
FIG. 10 is a perspective view of different elements of the multi-terminal block of FIG. 8.
Figure 11:
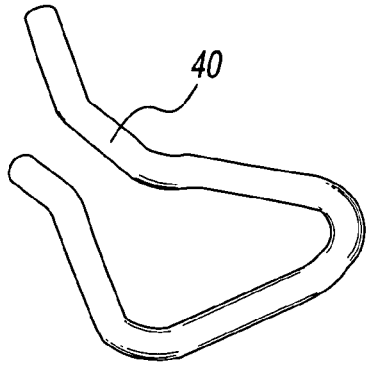
FIG. 11 is an enlarged perspective view of the spring wire used in the multi-terminal embodiment of FIG. 8.

FIG. 6 depicts screw 26 having a stopping point 28. FIG. 7 depicts terminal connector 22 with a pair of strip springs 20 disposed between a V-shaped leg support 30 which receives a clamping force during cable connection.

FIGS. 8-11 depict yet another embodiment according to the present disclosure, wherein the second terminal is of the stab and spring wire type 40. For this purpose, stab has double thickness, forms with folding one over other, one of whose ends is supported by a housing 42. The end is similar to fixed terminal 24. Central opening is made for opening/tightening part. Other end forms two branches which are closely held by spring wire 40 with a provided opening for insertion of conductor 23.

FIGS. 14*a*-*d* show an optionally embodiment, wherein the strip spring is rotated 180 degrees. Therefore, insertion window 6 is moved down, close to the cable insertion area, i.e., second terminal block 2.

While we have shown and described several embodiments in accordance with our invention, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. A multi-terminal block for electric devices, comprising two superimposed connecting levels for conductors, which can be used independent of each other, said multi-terminal block comprising:

a first terminal block comprising a cage screw type conductor connector which comprises a cage and a screw for use securing a first conductor, wherein said first terminal block cooperates with a terminal; and a second terminal block comprising a quick connecting type conductor connector, wherein said quick connecting type conductor connector comprises a strip spring for securing a second conductor, wherein said screw does not extend through said second terminal block and wherein said second terminal block is partially disposed within said cage such that said second terminal block cooperates with said terminal.

2. The multi-terminal block according to claim 1, wherein said terminal comprises an insertion window that communicates with said second terminal block.

3. The multi-terminal block according to claim 1, wherein said strip spring has a shape that resembles the number "5".

4. The multi-terminal block according to claim 1, wherein said strip spring is a metal sheet spring.

5. The multi-terminal block according to claim 1, wherein a pin type busbar is disposed within said insertion window and said second terminal block.

6. The multi-terminal block according to claim 2, wherein said strip spring comprises a free end which is elastically supported on a surface of said terminal substantially parallel to an axis of said insertion window.

7. The multi-terminal block according to claim 6, wherein said strip spring comprises a plurality of wings which holds said strip spring parallel to the axis of said insertion window.

8. The multi-terminal block according to claim 1, wherein said strip spring has a plurality of legs that hold said strip spring inside said second terminal block.

* * * * *

UNITED STATES PATENT AND TRADEMARK OFFICE

CERTIFICATE OF CORRECTION

PATENT NO. : 7,384,317 B1
APPLICATION NO. : 11/643466
DATED : June 10, 2008
INVENTOR(S) : Josep Pijoan Parellada et al.

It is certified that error appears in the above-identified patent and that said Letters Patent is hereby corrected as shown below:

Cover Page, Column 1,

Item (54) Title: please correct the word "Electronic" to read --Electric-- so that the proper title of the invention is:

--(54) MULTI-TERMINAL BLOCK FOR ELECTRIC DEVICES HAVING SUPERIMPOSED CONDUCTOR CONNECTING LEVELS--

Signed and Sealed this

Twenty-sixth Day of August, 2008

JON W. DUDAS
*Director of the United States Patent and Trademark Office*